US009462866B2

(12) United States Patent
Muhl et al.

(10) Patent No.: US 9,462,866 B2
(45) Date of Patent: Oct. 11, 2016

(54) BOWL

(75) Inventors: Till Nikolas Muhl, Hamburg (DE); Guenter Wissmann, Schenefeld (DE)

(73) Assignee: KAO GERMANY GMBH, Darmstadt (DE)

( * ) Notice: Subject to any disclaimer, the term of this patent is extended or adjusted under 35 U.S.C. 154(b) by 245 days.

(21) Appl. No.: 13/000,844

(22) PCT Filed: Aug. 5, 2009

(86) PCT No.: PCT/EP2009/060163
§ 371 (c)(1),
(2), (4) Date: Dec. 22, 2010

(87) PCT Pub. No.: WO2010/018114
PCT Pub. Date: Feb. 18, 2010

(65) Prior Publication Data

US 2011/0114107 A1 May 19, 2011

(30) Foreign Application Priority Data

Aug. 15, 2008 (EP) ..... 08162468

(51) Int. Cl.
*A45D 19/06* (2006.01)
*B44D 3/12* (2006.01)
(Continued)

(52) U.S. Cl.
CPC ..... *A45D 19/06* (2013.01); *B44D 3/121* (2013.01); *A45D 19/00* (2013.01); *A45D 19/02* (2013.01); *A45D 2019/0066* (2013.01); *A45D 2200/052* (2013.01); *A45D 2200/25* (2013.01)

(58) Field of Classification Search
CPC ..... A45D 44/00; A45D 19/00; A61Q 5/00
USPC ..... 132/200, 202, 208, 209, 270, 313; 206/581, 229, 568, 223, 361, 459.5, 206/232; 220/736, 570, 675, 672, 670; 40/324; 15/257.01, 257.05
See application file for complete search history.

(56) References Cited

U.S. PATENT DOCUMENTS 2,017,567 A * 10/1935 Meyer ..... A45D 19/02 206/361
D117,898 S * 12/1939 Carawan ..... D28/20
(Continued)

FOREIGN PATENT DOCUMENTS

BE 471 520 A 3/1947
DE 20 2004 019474 U1 12/2005
(Continued)

OTHER PUBLICATIONS

International Search Report dated Jan. 22, 2010.

*Primary Examiner* — Tatiana Nobrega
(74) *Attorney, Agent, or Firm* — Norris McLaughlin & Marcus PA

(57) ABSTRACT

A bowl (10) comprises a basin (12) and a holding means (28; 34) for positioning a tag (36). According to the invention the holding means (28; 34) is adapted to position the tag (36) on a different level than the level of a tool (18) resting on the basin (12) spaced to a bottom (14) of the basin (12). The bowl (10) may be shaped such, that the movement of the tool (18) take place within a predefined volume, wherein the tag (36) may be positioned at a region not interfering with the volume, where the tool (36) is in motion. Since a soiling of the tag (36) is prevented the information of the tag (36) may not be soiled, so that the risk of exchanging similar bowls (10) by mistake is reduced.

5 Claims, 3 Drawing Sheets

Figure 1:
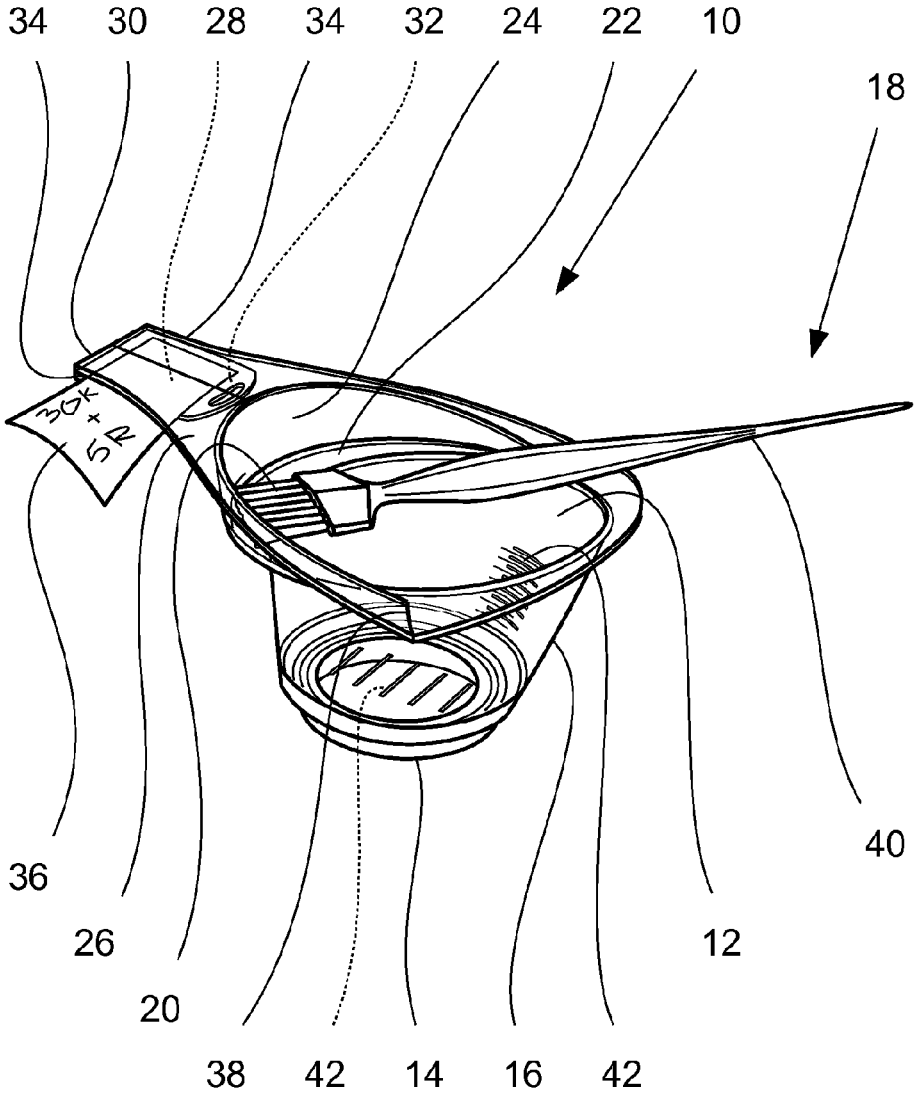

(51) Int. Cl.
*A45D 19/00* (2006.01)
*A45D 19/02* (2006.01)

(56) References Cited

U.S. PATENT DOCUMENTS

| | | | | | |
|---|---|---|---|---|---|
| D131,311 | S | * | 2/1942 | Sutton | D28/61 |
| 4,261,121 | A | * | 4/1981 | Coon | 40/332 |
| 4,882,862 | A | * | 11/1989 | Slavsky, Sr. | 40/324 |
| 4,927,046 | A | * | 5/1990 | Armstrong | 220/697 |
| 5,819,960 | A | * | 10/1998 | Bonazza | 211/133.1 |
| 5,913,450 | A | * | 6/1999 | Runkel | 220/696 |
| 6,105,816 | A | * | 8/2000 | Shea | 220/697 |
| 6,237,608 | B1 | * | 5/2001 | Kari | 132/208 |
| 6,485,691 | B1 | * | 11/2002 | Jones | 422/557 |
| 6,601,704 | B1 | * | 8/2003 | Pereira et al. | 206/459.5 |
| 6,868,980 | B2 | * | 3/2005 | Schultz et al. | 220/367.1 |
| 7,389,892 | B2 | * | 6/2008 | Park | 220/697 |
| 7,407,055 | B2 | * | 8/2008 | Rodriguez | 206/581 |
| 7,537,120 | B1 | * | 5/2009 | Cardenas | 206/581 |
| 7,644,835 | B2 | * | 1/2010 | Bergman | 220/736 |
| 2005/0081416 | A1 | | 4/2005 | Morris | |
| 2005/0139601 | A1 | * | 6/2005 | Thum | 220/574 |
| 2006/0231115 | A1 | * | 10/2006 | McNamara | 132/208 |
| 2007/0101629 | A1 | * | 5/2007 | Deniz | 40/666 |
| 2007/0119854 | A1 | * | 5/2007 | Rittmann | 220/570 |
| 2007/0169285 | A1 | * | 7/2007 | Narasimhan et al. | 8/405 |
| 2007/0205129 | A1 | * | 9/2007 | Kipry et al. | 206/503 |
| 2008/0035650 | A1 | * | 2/2008 | Rittmann | 220/570 |
| 2008/0130398 | A1 | * | 6/2008 | Ponsford | 366/111 |
| 2008/0289645 | A1 | * | 11/2008 | Guillot | 132/200 |
| 2010/0154816 | A1 | * | 6/2010 | Goddard-Clark et al. | 132/208 |
| 2010/0200012 | A1 | * | 8/2010 | Sloan | 132/200 |

FOREIGN PATENT DOCUMENTS

| | | | | |
|---|---|---|---|---|
| FR | 2724134 | * | 3/1996 | B44D 3/12 |
| GB | 497 044 A | | 12/1938 | |

* cited by examiner

BOWL

This application is a 371 application of PCT/EP2009/060163 filed Aug. 5, 2009, which claims foreign priority benefit under 35 U.S.C. §119 of EP application 08162468.6 filed Aug. 8, 2008

The invention relates to a bowl, particularly used in hair dressing practice. For instance such a bowl may be used as mixing bowl for mixing at least two components and/or compositions in any form, preferably in liquid, paste and powder form.

From WO 2006/066670 A1 a bowl for mixing a hair tinting lotion is known, which comprises a basin and a rim connected to the basin. The rim comprises a clamping means for clamping a tag, particularly a part of a hair coloration packaging. This tag carries information about the identity of the intended bowl content.

It is a disadvantage of such kind of a bowl that the information of the tag may be lost. When a user mixes a hair coloration composition by means of a brush, the user usually strips adhering composition from the brush at an edge of the rim. During this movement of the brush, the brush may hit the tag so that the information of the tag may be covered by the composition. The tag may further be hit by the brush, when the brush is laid horizontally on the rim of the basin. Due to the covering of the tag by the composition the information are not visible any more. Since more than one bowl may be used at the same time, different bowls without any information about their content may be exchanged by mistake leading to undesired effects. Especially in hair dressing and hair colouring practice, exchanging two bowls by mistake will result for instance in different shades on different parts of the hair, which may be very different from each other such as a natural brown tone on the one hand and an orange fashion tone on the other hand. Especially hair colours resulting from an oxidative reaction of one or more molecules are not fully reversible and therefore a correction is very difficult, if possible at all.

It is an object of the present invention to provide a bowl, which reduces the risk of exchanging similar bowls by mistake. It is particularly an object of the present invention to provide a bowl, which reduces the risk of soiling a tag connected to the bowl.

This object is achieved by the features of claim 1. Preferred embodiments are given by the dependent claims.

The bowl according to the invention comprises a basin and a holding means for positioning a tag. According to the invention the holding means is adapted to position the tag on a different level than the level of a tool resting on the basin spaced to a bottom of the basin.

The bowl may be shaped such, that the movement of the tool, particularly a brush, spoon or the like, which may be used together with the bowl, take place within a predefined volume, wherein the tag may be positioned at a region not interfering with the volume, where the tool is in motion. Since a soiling of the tag is prevented the information of the tag may not be covered by the mixed composition, so that the information is continuous present. This reduces the risk of exchanging similar bowls by mistake. Since the basin is shaped for supporting the tool particularly in a predefined rest position, a predefined volume for the tool both in motion as well as resting is given. Particularly an undefined resting of the tool on an upper edge of the basin is prevented protecting the tag. The holding means is particularly adapted to place the tag horizontally and/or vertically spaced to the tool in rest position preferably outwards with respect to the basin. The holding means is particularly one-piece with the basin. The holding means is particularly adapted for applying a holding force onto the tag, for instance by clamping. The tag can be particularly held unmovable by the holding force as long no external forces are applied, so that the tag is securely connected by the holding means and can not be disconnected by its own weight and/or by air movements inside a room. The holding means is particularly adapted for receiving the tag from above, this means the tag can be connected by a downward movement to the holding means. The holding means is particularly adapted for receiving the tag such that the tag is at least partially accessible from above, wherein the tag may lay at least partially on the holding means and/or on the basin, so that the own weight of the tag leads to an additional holding force by friction. The holding means is preferably adapted such that in case that the tag is disconnected from the holding means the tag does not falls down. Most preferred a part of the basin is arranged below the tag, when held by the holding means. The tag is particularly made from a flexible material like paper or carton. The basin may comprise any shape suitable for receiving a fluid and/or a paste or other content. The basin usually may comprise a mainly flat horizontal bottom connected to a circumferential wall, which defines an opening for inserting the components for the composition or other content. The wall may be connected to a rim particularly protruding from the basin outwards, wherein the holding means may particularly arranged further outwards with respect to the rim.

The level of the tool resting on the basin is a tool resting level provided by the basin. The level of the tool is understood as a plane defined by the tool placed in the intended rest position on the basin. This plane is defined by the shape of basin, wherein a plurality of different shapes is possible for forming a defined rest position for the tool. For example the basin may comprise two recesses arranged on opposite parts of the basin, wherein a grab handle of a shaft of a brush can be placed into the recesses in the intended rest position. The alignment of this shaft of the brush defines the level of the tool, which is different from the level of the tag. In a further embodiment one recess for receiving the shaft of the brush and a rim for placing the bristles of the brush can be provided, so that a definite alignment of the brush for defining the level of the tool is given by the shape of the basin. In this embodiment the level of the tool may be inclined with respect to a horizontal plane and/or inclined to a plane defined by the upper surface of the rim. The tag can be placed by means of the holding means at a level and a position, where the tag does not interfere with the tool in motion and/or with the tool in rest position. Particularly a barrier is arranged between the tag and the tool in rest position, which would block the movement of the tool towards the tag before the tool would come into contact with the tag.

Particularly the holding means is adapted to hold the tag on a higher level in vertical direction with respect to the tool in rest position. Due to the raised level the tag is well visible. Since the tag is arranged higher than the tool in rest position, the tool may not accidently hit the tag. Particularly it is possible to compare the composition on the brush with the information of the tag. For instance the tag may show a colour example, which can be compared to the colour of the composition adhering at the brush.

Preferably the basin is adapted to support the tool mainly horizontally. The basin may comprise a deepening like a deepened edge or shoulder particularly for placing the bristles of the brush and/or a shaft of the brush on the deepening, wherein the movement of the tool in radial direction may be limited by an outer border wall of the deepening. A movement of the tool in circumferential direction may be limited by the deepening. Due to the deepening the tool may be rest in a predefined position and alignment. Since the tool may be supported horizontally, the tool can be easily picked up.

In a preferred embodiment the basin comprises a rim for supporting the tool in rest position. The rim may comprise a deepening for placing the bristles of the brush and/or a shaft of the brush on the deepening. Due to the rim a plane contact of the basin the tool is provided. Particularly all bristles of the brush may be supported by the rim leading to a secure resting without the danger that the tool may slide from the basin. The rim is particularly one-piece with the basin.

Particularly a border wall protruding in mainly vertical direction from the rim is provided. Preferably the holding means is connected to the basin via the border wall. Due to this design the tool as well as the composition adhering at the tool are limited in their movement such that the tag is not hit. The movement of the resting tool in radial direction may be limited by the outer border wall protruding upwards from the rim. Since the holding means is connected to basin only via the border wall, the border wall prevents a soiling of the tag. If so, only the border wall and the rim are soiled but not the tag. Particularly the holding means may be connected to the border wall via a further rim and/or the holding means may be formed by the further rim. The border wall and/or the further rim is particularly one-piece with the basin.

Preferably the holding means protrudes outwards from the rim. The tag may protrude further outward increasing the distance to the volume, where the motion and/or resting of the tool takes place. For instance a further rim connected to the rim on a different level is provided, wherein the holding means is connected to the further rim or formed by the further rim.

Particularly the holding means comprises a slit for receiving at least partially the tag. The slit may be easily formed into a part of the bowl forming the holding means. Due to the slit tags of different shape and size may be used, since it is sufficient to stick a part of the tag into the slit. Since the thickness of paper products and/or a packaging is usually constant, one slit size fits nearly all kinds of tags. Particularly a clamping is not necessary since the tag may be held by friction only, wherein the friction force may be increased when a part of the tag protrudes from the slit. Most preferred the slit is open in a radial direction with respect to the basin as well as in a lateral direction with respect to the radial direction. If so the slit may comprise several openings separated to each other by connecting webs for connecting an upper part of the holding means to a lower part. Depending on the alignment of the information on the tag the tag may be inserted into the slit in radial direction and/or in a direction mainly perpendicular with respect to the radial direction.

Particularly a grab handle directly or indirectly connected to the basin is provided, wherein the grab handle particularly comprises the holding means. When the mixed composition is applied to the hair the user, for instance a hair dresser, may hold the bowl be means of the grab handle. Thus, the grab handle is near to the eyes of the user so that the user may easily be aware of the information of the tag. The risk, that the coiffeur may take the false bowl and apply the wrong hair tinting and/or wrong hair coloration is reduced. The grab handle is particularly one-piece with the basin.

Preferably the grab handle comprises a handle part pointing mainly downwards, wherein the holding means is adapted such that the tag overhangs the handle part. The holding means, particularly a slit forming the holding means, may be provided at an intermediate area between a horizontal and a vertical part of the grab handle. Due to the overhanging tag at the holding hand of the user, the user is forced to be aware of the tag and to recognise the information provided by the tag.

In a preferred embodiment the grab handle extends at least partially downwards until the level of the bottom of the basin. Not only the bottom of the basin but also the grab handle provide a good and secure standing of the bowl. The tilting tendency of the bowl, particularly during the mixing, may be significantly reduced. Further the basin may be designed partially inclined without increasing the risk of tilting. Due to the inclined design of a part of the circumferential wall of the basin a user may paint the composition at the inclined part of the wall for checking the colour of the composition.

In a further embodiment a receiving recess for receiving a part of the tool is provided. The receiving recess may be provided at an upper edge of the basin and/or the rim and/or a border wall protruding from the rim. Due to the receiving recess the tool may be positive fit rested. This leads to a defined rest position of the tool.

Preferably a scale, particularly two scales on opposing sides of the basin wall, may be provided for measuring the volume of a received content. A further scale on the bottom of the basin may be provided for measuring the length of a past-like material applied by means of a tube. Preferably the scale(s) is/are formed by the basin.

Preferably the holding means is mainly transparent and/or comprises a window for a visual access to a received part of the tag. No information of the information may be invisible. Further the tag may be protected against the environment, for example spray water, which may occur in a hair dresser shop.

Particularly the holding means comprises a moveable lug, particularly comprising a film hinge, wherein the lug is adapted to be moved into a holding position for holding the tag, wherein the lug is particularly adapted to be fastened in the holding position. Due to the movable lug a slit for receiving the tag may be provided at will. Further the lug may be adapted to clamp the tag between the lug and a further part of the bowl. The lug may fastened to a part of the bowl, particularly to a grab handle, be means of a protrusion press fitted into a corresponding opening.

Preferably the basin, the holding means and, if so, the grab handle are one-piece. It is not necessary to connect each part to the other by means of fastening means or the like. The whole bowl may made by injection die casting of a plastic material.

Preferably the bottom of the basin may comprise an anti-slip and/or skid-proof standing surface, for instance by means of a rubber-like material.

Particularly the bowl is shaped such that an identical shaped bowl may be inserted into the first bowl saving space.

Further the outer surfaces of the bowl, particularly at least partially the surfaces facing downwards, may comprise a gripping structure, which enables a better holding of the bowl by means of the hand of the user.

The invention further relates to a mixing system for mixing at least two components and/or compositions in any form, preferably in liquid, paste and powder form, particularly a hair tinting or coloration lotion. The mixing system comprises a bowl, which may be designed as previously described, and a brush for mixing and applying the composition, wherein the brush is adapted to rest on the basin such that a shaft of the brush partially protrudes from the basin. Due to the overhanging shaft a defined part of the shaft for gripping the brush is provided. The movement of the brush may better be foreseen so that the tag may be prevented from being soiled.

Preferably the shaft of the brush is as least partially positive fitted by the bowl. This leads to a definite alignment of the brush. The overhanging part of the brush may be ergonomically optimized arranged.

The invention further relates to a use of a bowl, which is designed as previously described, for mixing at least two components and/or compositions in any form, preferably in liquid, paste and powder form, particularly for mixing a hair tinting or hair coloration lotion. The use of this bowl reduces the risk of soiling a tag connected to the bowl. This reduces the risk of exchanging similar bowls by mistake.

The invention further relates to a method for a treatment of hair, comprising the steps of providing a bowl, which is designed as previously described, filling the basin of the bowl with at least two components of a hair treatment composition, providing the bowl with a tag identifying the components and/or the composition, mixing the components for receiving the hair treatment composition and applying the hair treatment composition to the hair, particularly for tinting, bleaching and/or colouring the hair. The use of this bowl reduces the risk of soiling a tag connected to the bowl. This reduces the risk of exchanging similar bowls by mistake. This prevents to apply the wrong colour to the hair.

In the following the invention is explained in further detail with reference to the accompanying drawings be means of preferred embodiments.

Figure 2:
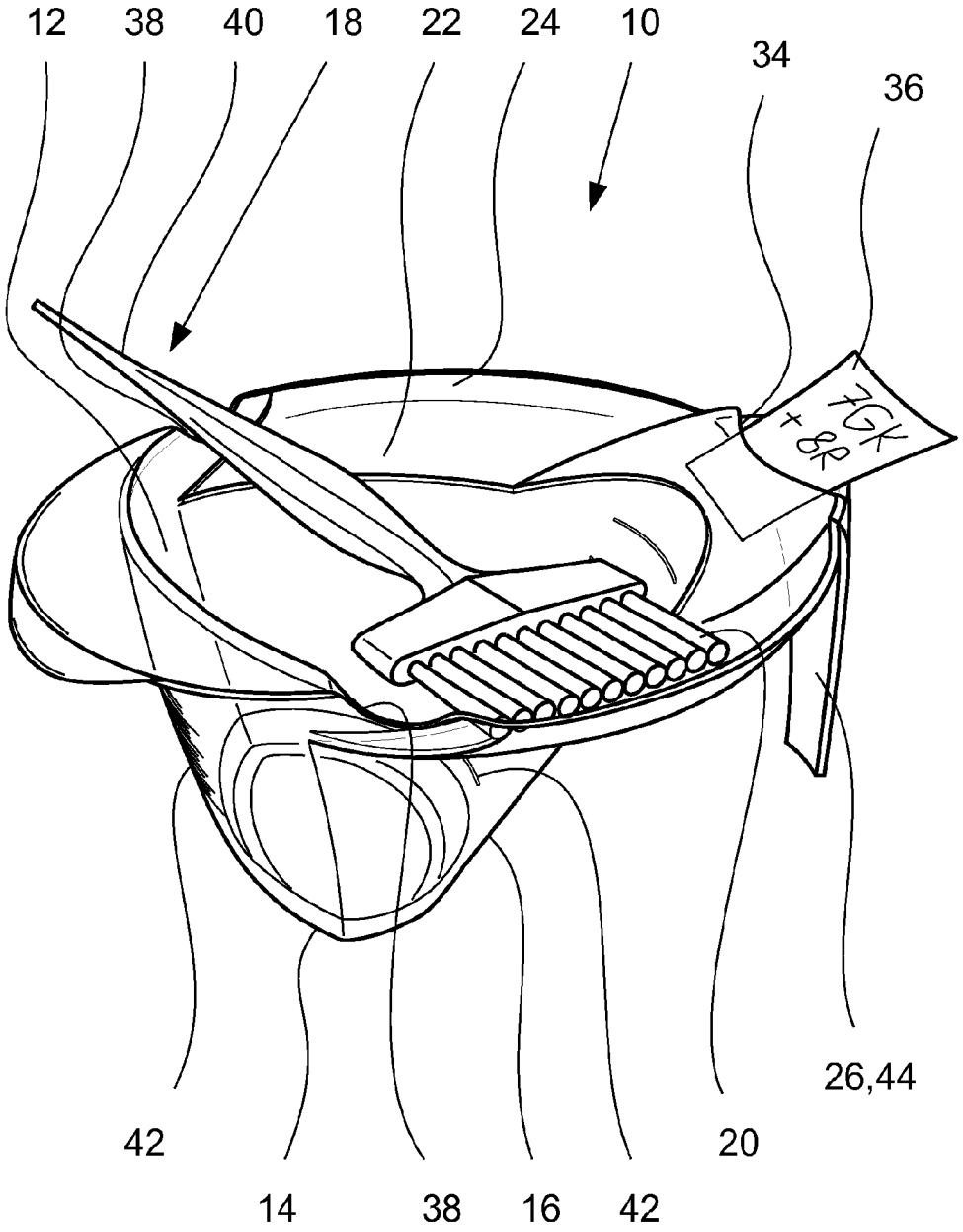
Figure 3:
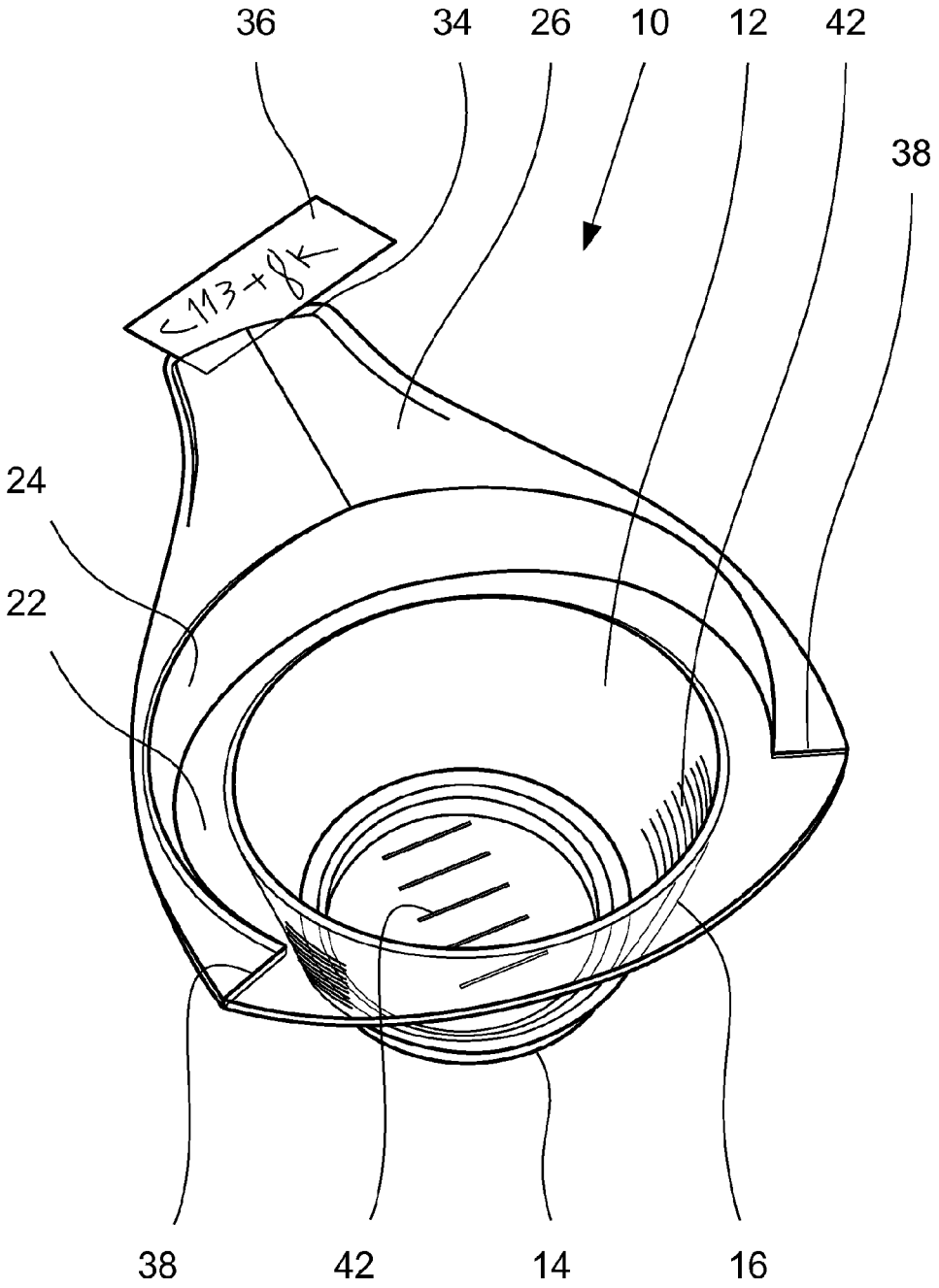

In the drawings:

FIG. 1 shows a schematic perspective view of a bowl according to the invention in a first embodiment, FIG. 2 shows a schematic perspective view of a bowl according to the invention in a second embodiment and FIG. 3 shows a schematic perspective view of a bowl according to the invention in a third embodiment.

The bowl 10 as illustrated in FIG. 1 comprises a basin 12. The basin 12 comprises a bottom 14 and a circumferential wall 16 defining an opening for inserting components for a composition to be mixed. For mixing the composition a brush 18 is provided. The brush comprises bristles 20 resting on a rim 22 protruding mainly horizontally outwards with respect to the basin 12. From the rim 22 protrudes a border wall 24 mainly vertically upwards for limiting the movement of the brush 18 in radial direction. Due to the rim 22 and the border wall 24 a half-moon-shaped depression for receiving the brush 18 or the bristles 20 of the brush 18 is given.

Further a grip handle 26 is provided protruding mainly horizontally from the border wall 24. The grip handle 26 comprises a lug 28 pivotable connected to the grip handle 26 by means of a film hinge 30. The lug 28 may be fastened to the grip handle 26 via a fastening means 32, which comprises a press fitted protrusion within a corresponding notch. Due to the fastened lug 28 slits 34 are provided for holding a tag 36 comprising information about the composition to be mixed. Since the tag 36 is arranged spaced to the brush 18 and at a higher level than the rim 22, a user is aware of the information of the tag 36 but the tag 36 can not be soiled by the brush 18.

The rim 22 of the bowl 10 comprises a recess 38 for receiving a shaft 40 of the brush 18. In the illustrated embodiment the recess 38 as well as the shaft 40 are angularly shaped for providing a positive-fit of the shaft 40 within the recess 38. The recess 38 is particularly positioned at an area lower than the border wall 24 and particularly at the lowest area of the rim 22, so that the shaft 40 may automatically roll into the recess 38.

In the illustrated embodiment at the bottom 14 as well as at the circumferential wall 16 of basin 12 scales 42 are provided.

The bowl 10 as illustrated in FIG. 2 comprises in comparison to the bowl 10 of FIG. 1 a grip handle 26, which comprises a handle part 44 pointing mainly downwards until the level of the bottom 14 of the basin 12. At the transition between the border wall 24 and the vertically part of the grip handle 26 the slit 34 for holding the tag 36 is provided. The tag 36 overhangs the vertical handle part 44.

Since the grip handle 26 provides additional stability the basin 12 may be shaped such that a part of the circumferential wall 16 may be inclined. The scale 42 arranged at the inclined part of the circumferential wall 16 comprises level lines, which are more spaced to each other so that a more precise measurement is possible. Further the rim 22 and the border wall 24 comprises a rounded and smoother transition.

The bowl 10 as illustrated in FIG. 3 omitted in comparison to the bowl of FIG. 1 the lug 28. Instead of the omitted lug 28 only a slit 34 is provided at the radially end of the grip handle 26. The tag 36 is in the illustrated embodiment only partially inserted into the slit 34 so that the overhanging part of the tag 36 comprises a force into gravity direction leading to an increased friction force inside the slit 36. Further the basin 12 is shaped more oval leading to a design, which may be more ergonomically for different users with hands of different size.

The invention claimed is:

1. A hair dye mixing bowl for use in mixing at least two components of a hair treatment composition for tinting, bleaching and/or coloring hair, the mixing bowl comprises:

a basin having a horizontally extending bottom wall and circumferential side wall extending vertically from the bottom wall, the side wall defining an upper-most edge defining an opening for inserting compositions to be mixed;

a rim for supporting a brush in a mainly horizontal rest position, the rim protruding horizontally and radially outwards from the upper-most edge of the basin, the rim extending around the entire opening of the basin and terminating at an outer edge opposite the upper-most edge of the basin;

a border wall protruding vertically from the outer edge of the rim along only a portion of the rim and terminating at an upper-most edge, where the rim and border wall define a half-moon shaped depression for receiving and supporting bristles of the brush, a remaining portion of the rim from which the border wall does not extend defining a free terminal frontal edge of the bowl and the remaining portion of the rim provides a support surface for supporting a handle portion of the brush, wherein movement of the resting brush in a radial direction is limited by the border wall due to interference with a handle portion of the brush; and a handle protruding horizontally and radially outwards from a portion of the upper-most edge of the border wall opposite the remaining portion of the rim, the handle having a holding means for securing a tag thereon at a higher level in the vertical direction than the brush in the rest position, the holding means comprising a slit for receiving at least partially the tag.

2. The mixing bowl according to claim 1, wherein a portion of the border wall adjacent the remaining portion of the rim and the remaining portion of the rim define a recess for receiving a portion of the brush handle.

3. A mixing system for mixing at least two components and/or compositions, the system comprising the mixing bowl according to claim 1 and a a brush or spoon for mixing and applying the components, wherein the brush or spoon are adapted to rest on the rim such that a handle portion thereof partially protrudes from the rim.

4. A hair dye mixing bowl for use in mixing at least two components of a hair treatment composition for tinting, bleaching and/or coloring hair, the mixing bowl comprises:

a basin having a horizontally extending bottom wall and circumferential side wall extending vertically from the bottom wall, the side wall defining an upper-most edge defining an opening for inserting compositions to be mixed;

a rim for supporting a brush in a mainly horizontal rest position, the rim protruding horizontally and radially outwards from the upper-most edge of the basin, the rim extending around the entire opening of the basin and terminating at an outer edge opposite the upper-most edge of the basin;

a border wall protruding vertically from the outer edge of the rim along only a portion of the rim and terminating at an upper-most edge, where the rim and border wall define a half-moon shaped depression for receiving and supporting bristles of the brush, a remaining portion of the rim from which the border wall does not extend defining a free terminal frontal edge of the bowl and the remaining portion of the rim provides a support surface for supporting a handle portion of the brush, wherein movement of the resting brush in a radial direction is limited by the border wall due to interference with a handle portion of the brush; and a handle protruding horizontally and radially outwards from a portion of the upper-most edge of the border wall opposite the remaining portion of the rim, the handle having a holding means for securing a tag thereon at a higher level in the vertical direction than the brush in the rest position, the holding means comprising a lug pivotably connected to the handle via a film hinge formed at an outer terminal edge of the handle, a portion of the lug opposite the film hinge and a corresponding portion of the handle having cooperating fastening means for selectively securing the portion of the lug to the handle.

5. The mixing bowl according to claim 4, wherein the fastening means comprise a press fitted protrusion and a corresponding notch.

* * * * *